United States Patent [19]

Anderson

[11] 4,076,080

[45] Feb. 28, 1978

[54] FRONT END LOADER ATTACHMENT

[75] Inventor: Walter J. Anderson, Two Harbors, Minn.

[73] Assignee: Milton I. Larson, Two Harbors, Minn.

[21] Appl. No.: 672,837

[22] Filed: Apr. 1, 1976

Related U.S. Application Data

[63] Continuation of Ser. No. 516,746, Oct. 21, 1974, abandoned.

[51] Int. Cl.[2] ..... E02F 3/76

[52] U.S. Cl. ..... 172/804; 37/117.5; 172/247; 172/253

[58] Field of Search ..... 172/245, 247, 250, 251, 172/253, 776, 801, 804, 805, 806, 809; 37/117.5, DIG. 15; 214/768

[56] References Cited

U.S. PATENT DOCUMENTS

| | | | |
|---|---|---|---|
| 2,365,677 | 12/1944 | Burns | 172/809 |
| 2,559,816 | 7/1951 | Alexander | 172/804 |
| 2,624,132 | 1/1953 | Henry | 172/809 |
| 2,732,963 | 1/1956 | Grubich | 172/801 X |
| 2,935,802 | 5/1960 | Wolfe et al. | 37/117.5 |
| 2,950,550 | 8/1960 | French | 172/804 |
| 3,440,744 | 4/1969 | Smith | 37/117.5 |
| 3,591,935 | 7/1971 | Bremmer et al. | 37/117.5 |
| 3,665,622 | 5/1972 | Lamb | 37/117.5 |
| 3,866,342 | 2/1975 | Cooper | 37/117.5 |

*Primary Examiner*—Richard T. Stouffer
*Attorney, Agent, or Firm*—Schroeder, Siegfried, Ryan, Vidas & Steffey

[57] ABSTRACT

A blade mounting assembly for mounting a blade on a front end loader vehicle to provide the desired attributes of a bulldozer. The blade is pivotally mounted on a U-shaped frame which is pivotally mounted on the push beam assembly of the front end loader. The front end loader hydraulic motors are used to control blade pitch, and hydraulic motors mounted on the frame are used to control blade angle. The geometry of the assembly allows setting blade tilt by combining blade pitch and angle.

4 Claims, 6 Drawing Figures

FRONT END LOADER ATTACHMENT

This is a continuation, of application Ser. No. 516,746, filed Oct. 21, 1974, now abandoned.

The present invention is directed to an improvement in blade mounting assemblies, and more particularly to a mounting assembly for mounting a blade on a front end loader vehicle to provide functions normally available only in a bulldozer.

Numerous various blade configurations are known in the prior art. These blades as mounted provide various combinations of pitch, tilt and angle to provide many and various functions. Many of the prior art mounting arrangements are quite complex requiring a large number of hydraulic motors, universal joints and other complex mechanisms. Such prior art structures, however, are relatively complex and expensive and are not readily adaptable for use in conjunction with front end loaders.

Ownership of front end loaders is relatively common since they are relatively simple and inexpensive. These front end loaders, however, while excellent for their intended purpose, are limited in their functions, and it would be helpful to have a front end loader vehicle which could perform in a dual role as either a front end loader for scooping up a load of material and lifting and depositing it on a truck, or as a bulldozer for either pushing large loads of heavy material or for grading a surface. Unfortunately, however, the normal front end loader is not properly equipped to permit it to function as a bulldozer. My invention is directed toward enabling the owner of a front end loader to quickly, readily and inexpensively obtain these functions from said vehicle.

In addition to use of the blade mounting attachment on front end loader vehicles, I have also found it to be useful as an attachment for a log skidder vehicle to make that vehicle function in a much more versatile manner.

In the preferred embodiment of the present invention, a blade is supported by a centrally located pivot point on a frame. Blade angle about a vertical axis defined by the pivot point is controlled by a pair of hydraulic motors anchored to the frame. Blade pitch about a horizontal axis perpendicular to the direction of vehicle travel is controlled by actuation of the hydraulic motors which are normally used for the front end loader configuration to dump the bucket. Blade tilt about a horizontal axis parallel to the direction of vehicle travel may be adjusted by variation of blade angle and blade pitch in combination as will be shown below.

The mounting arrangement of the present invention can be readily substituted for a conventional front end loader bucket by making only four mechanical connections to the front end loader push beam assembly and by connecting the vehicle's hydraulic power to the hydraulic pistons and cylinders which are mounted on the attachment mounting frame. Thus, conversion from the front end loader operating mode to the bulldozer operating mode and reconversion back to the front end loader mode is a relatively simple procedure, allowing optimal use of the vehicle in either role.

Accordingly, it is an object of my invention to provide a novel and improved blade mounting attachment for a front end loader.

It is another object of the present invention to provide a blade mounting attachment which may be easily and readily attached to a front end loader to provide bulldozer functions.

It is a further object of the invention to provide a blade mounting attachment for use on a front end loader to provide bulldozer functions which utilizes the same pitch controls as the front end loader.

It is a further object of the invention to provide a blade mounting attachment which has a geometry permitting adjustment of blade tilt by variation of blade angle and pitch in combination.

It is a further object of the present invention to provide a mounting arrangement which can be readily installed on a front end loader with a minimum of changes to the front end loader vehicle, the push beam assembly and the associated hydraulic actuators and thereby provide many, if not all, of the functions normally available in a bulldozer.

These and other objects of the invention will become apparent from the attached description together with the drawings wherein.

Figure 1:
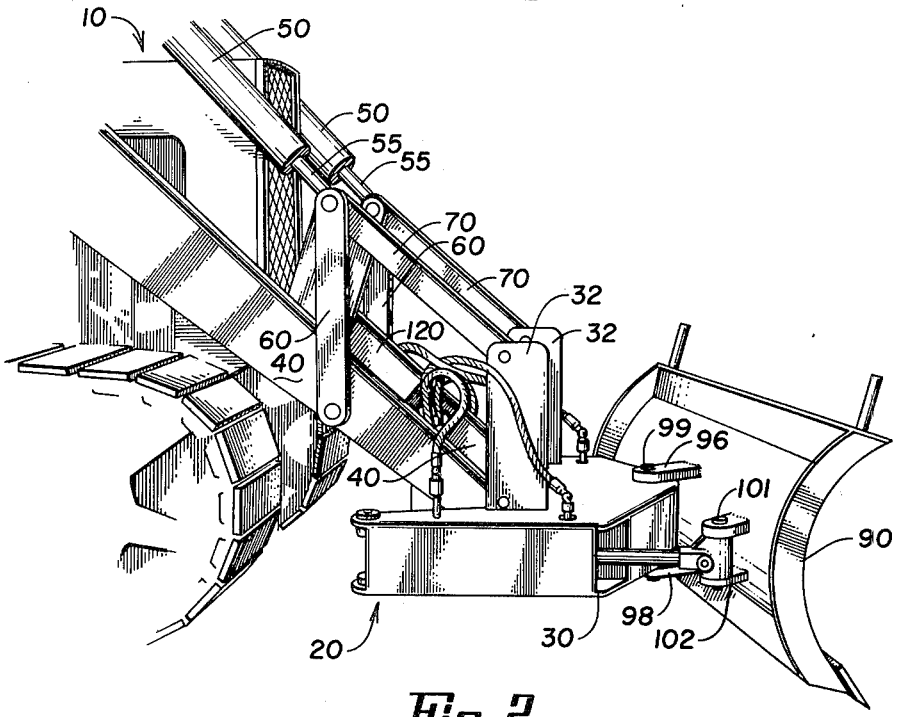
FIG. 1 is a perspective view of my blade and blade mounting attachment supported on a front end loader vehicle.

The invention lies in a blade mounting attachment shown in perspective in FIG. 1 to show the relationship of parts. Such a structure may be used with a front end loader vehicle of either a tracked or wheeled variety and converts the vehicle for all practical purposes into one capable of performing bulldozer functions.

In FIG. 1, a vehicle 10 is shown with a blade mounting assembly 20 attached and positioned for use. Mounting assembly 20 consists of a generally U-shaped frame 30 which supports a pair of parallel upright arms 32. Assembly 20 is connected to a push beam assembly 40 which is then in turn connected to vehicle 10.

For various types of front end loaders, a number of alternative attachments for connecting the push beam assembly 40 to the vehicle are known, but all of the methods provide, in one way or another, for rotation of the assembly 40 about some pivot point displaced from the load supporting end of assembly 40 so that rotation of the assembly about the pivot point by action of a hydraulic motor attached to the vehicle will result in either a raising or a lowering of the load bearing end of the assembly. In front end loader vehicles, the height of the pivot point is normally somewhat higher than the track or wheel of the vehicle, while in a traditional bulldozer vehicle the height of the pivot point of the push beam assembly is commonly relatively low, usually below the top of the vehicle track or wheel. For either vehicle, however, the present blade mounting attachment is workable, although it is primarily intended for use with front end loader vehicles.

Figure 2:
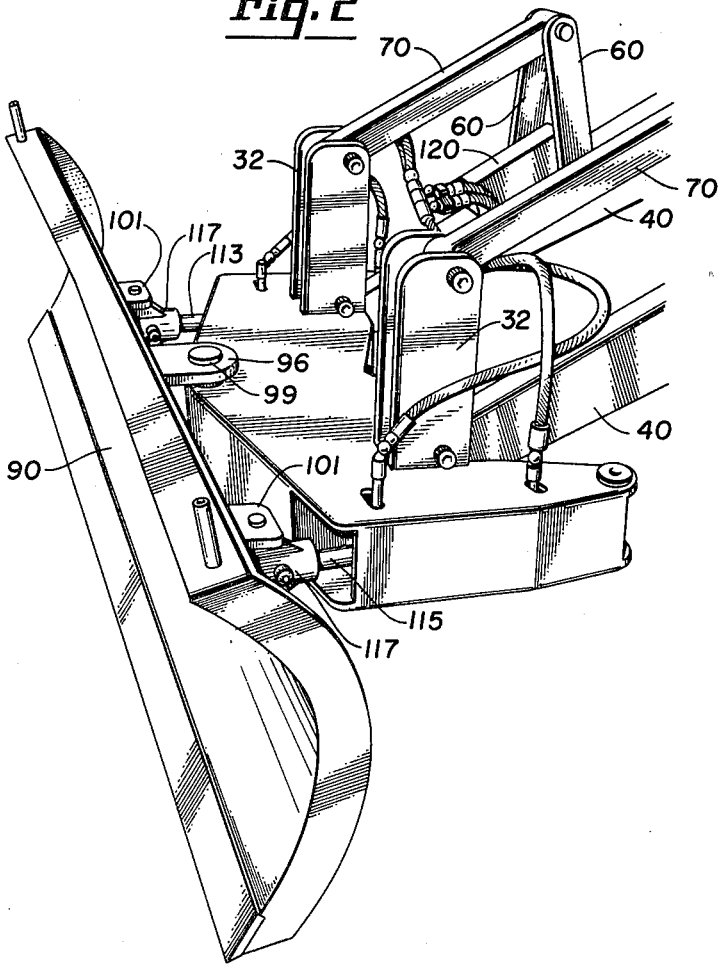
FIG. 2 is a side view in elevation of the blade and supporting structure of FIG. 1.

As illustrated in FIGS. 1 and 2, a pair of hydraulic piston and cylinder jacks 50 are mounted along an axis parallel to that of the push beam assembly 40. The cylinder of each of the hydraulic motors 50 is pivotally attached to the push beam assembly 40, and the piston 55 is pivotally connected to one end of each of a pair of links 60, the other end of each of which is pivotally connected to either side of one of the arms of push beam assembly 40. A second link 70 is also connected at one end to the clevis formed by links 60 and the piston of hydraulic jack 50. These links 60 and 70 are the conventional bucket control links of a front end loader. The other end of each link 70 is pivotally connected to the top of a vertical member 32 which is attached to frame 30. Each of the arms of the push beam assembly 40 is pivotally connected to the base of a vertical member 32. Each of the pivotal connections provides for relatively free rotational movement about a single axis.

A blade 90 is shown attached to frame 30. An upper flange 96 and a lower flange 98 overlap the top and bottom surfaces of the frame 30 of blade assembly 20. A pin 99 inserted through upper flange 98, frame 30, and lower flange 98, forms a clevis permitting relatively free rotational movement of the blade about the axis of pin 99. The forward or leading edge of frame 30 is tapered in a "V" shaped projection at the point of attachment with blade 90 so that relatively free rotational movement of blade 90 about the axis defined by pin 99 can occur, but within reasonable limits.

Figure 3:
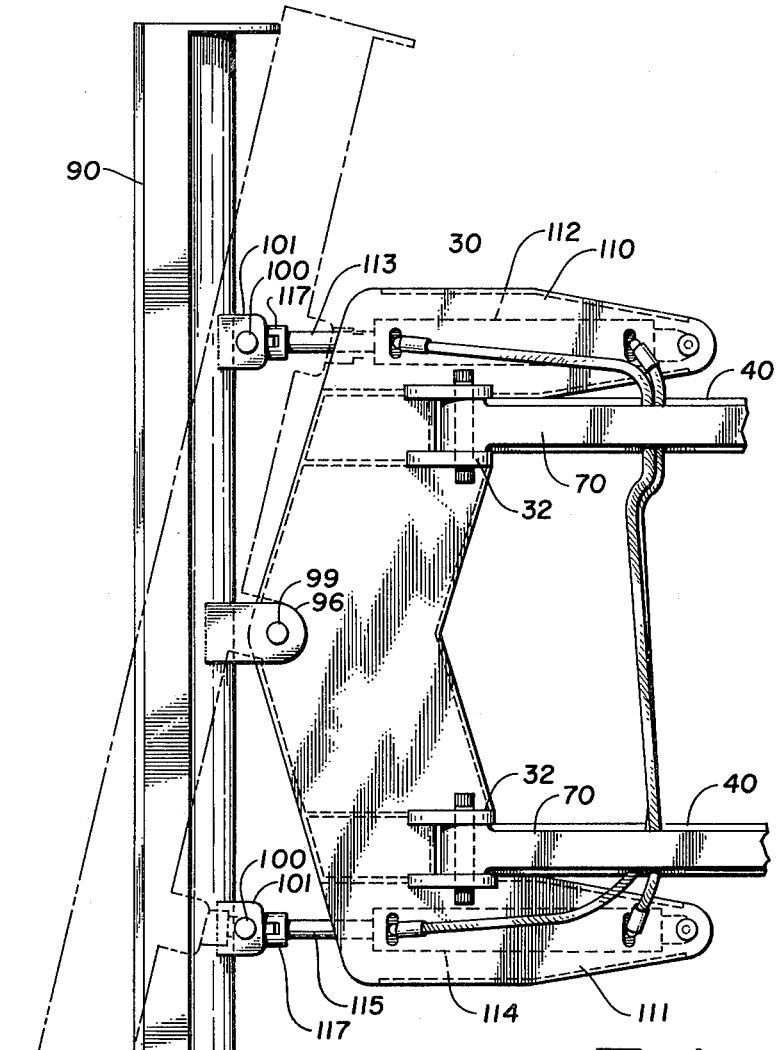
FIG. 3 is a top view of my blade mounting attachment and blade illustrating in phantom lines the various angular positions of the blade which may be achieved by actuation of the hydraulic motors.

A pair of hydraulic jacks 110 and 111 are connected to frame 30 and to blade 90. The hydraulic jack cylinders 112 and 114 are pivotally connected to a rear portion of frame 30, and their associated hydraulic jack pistons 113 and 115 each have a clevis 117 on one end which is pivotally connected by a pin 100 which is inserted through clevis 117 and flanges 101 and 102 which project from the back of the blade 90. The extension of piston 115 from jack cylinder 114 and retraction of piston 113 into cylinder 112 results in a clockwise rotation of the blade 90 about the axis defined by the pin connecting the center of the blade to the center of frame 30 to the phantom position illustrated in FIG. 3, a top view of the blade mounting assembly.

Figure 4:
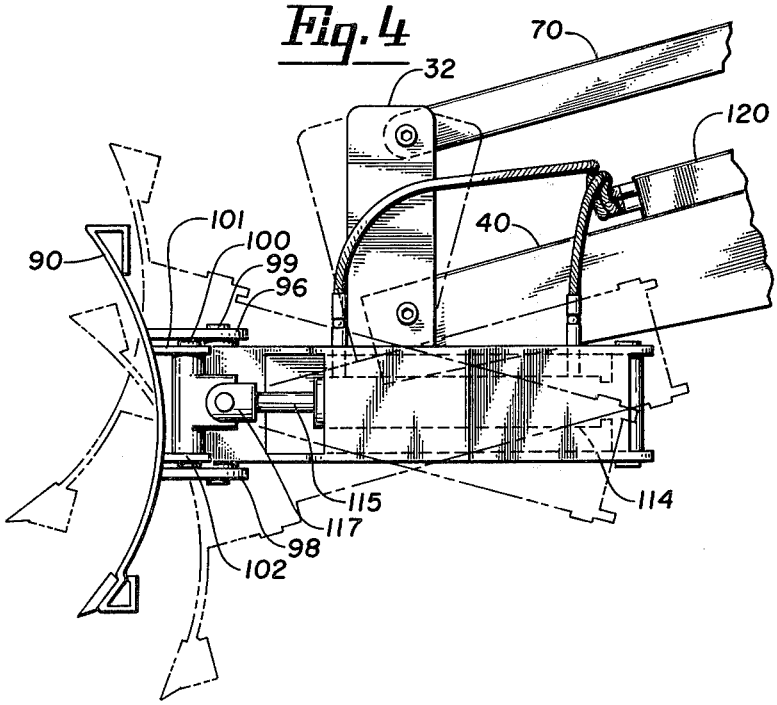
FIG. 4 is a side view of my blade mounting attachment and blade illustrating in phantom lines the variation in pitch position which may be achieved by actuation of the vehicle front end loader bucket controls.

FIG. 4 illustrates in phantom outline several of the pitch positions of the blade which may be achieved by actuation of the hydraulic jacks 50 which induce a rotation around the pivotal connection between the push beam assembly arms 40 and the lower portion of the parallel upright arms 32 of the frame 30. The views in FIG. 4 illustrate the blade in its neutral position with pistons 115 and 113 equally extended and blade 90 perpendicular to the direction of motion of the vehicle. Adjustment of the blade pitch when the blade is in the neutral position does not result in any change in blade tilt due to changes in pitch. It can also be seen that adjustment of the blade pitch by actuation of hydraulic jacks 50 must be combined with an adjustment of the height of the ends of the push beam assembly 40 to assure that the lower edge of blade 40 is maintained at a fixed elevation from the ground.

Figure 5:
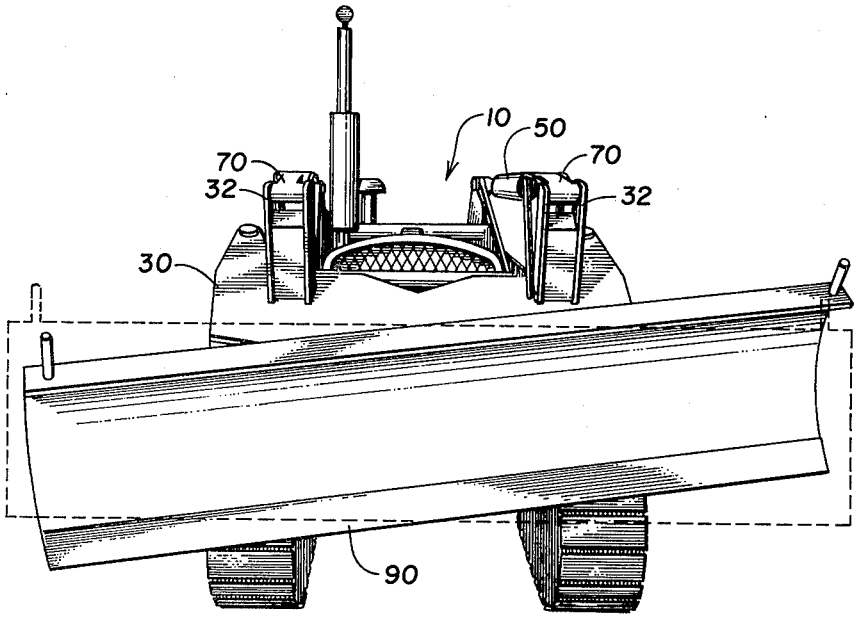
FIG. 5 is a front view of the vehicle and attached blade showing the blade tilt which can be achieved by combining pitching of the blade and adjustment of the blade angle.

FIG. 5 is a front view of the vehicle mounting attachment and blade, showing the blade angled to the operator's left and the mounting assembly 20 pitched forward at a sharp angle. The combination of the pitch of the frame 30 and the angling of the blade 90 by operation of hydraulic jacks 110 and 111 results in a blade tilt which can be used to advantage to grade road surfaces and the like. It may be seen that variation of blade angle and pitch in combination can be used to control the amount of tilt.

It may be seen that the vertical axis about which the blade angle is varied is displaced substantially from the rotational axis at the point of connection between push beams 40 and frame 20. It is this displacement of the two axis of rotation of the blade 90 which provides the effective rotation of the blade about the vehicle axis when there is a concurrent displacement about the vertical axis and the axis transverse to the vehicle axis. This geometry allows one to achieve cross coupling between the blade pitch tilt and angle axes.

As indicated above, control of the blade angle is accomplished by use of hydraulic jacks 110 and 111. The jacks may be readily controlled using a conventional hydraulic control circuit 120 to extend one jack at the same time the opposite jack is being retracted. Although in the preferred embodiment this control means is illustrated as being carried by the push beam assembly 40, it is clear that it can be equally well located with the remainder of the vehicle controls so that the driver can adjust the blade angle from the driving position. The controls for the vehicle hydraulic jack 50 are located in close proximity to the driver and are unchanged from the control configurations utilized with the front end loader bucket attached to the push beam assembly 40.

Figure 6:
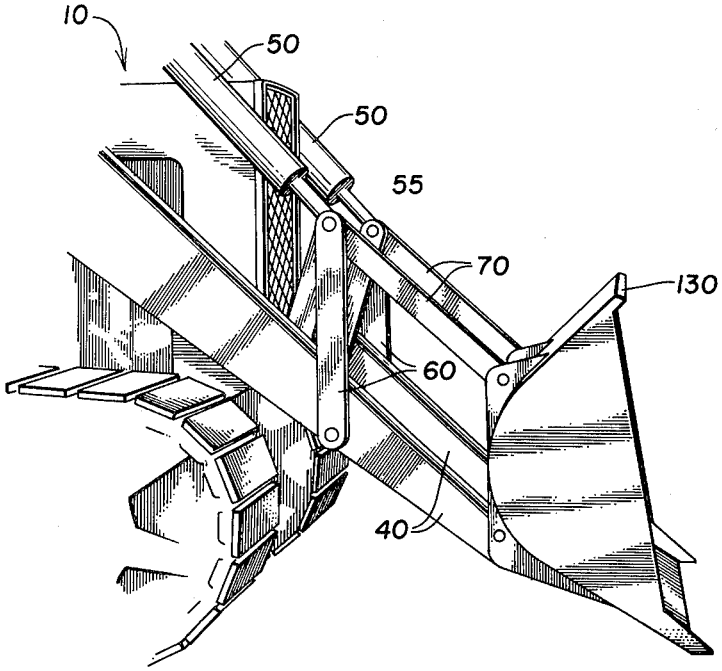
FIG. 6 is a side view of the front end loader vehicle with my blade mounting attachment removed and a front end loader bucket installed.

FIG. 6 illustrates the front end loader vehicle and push beam assembly connected directly to a front end loader bucket 130. It is noted that the bucket control or push beam assembly links 60 and 70, and the hydraulic motors 50 are in precisely the same configuration as shown in connection with my new blade mounting attachment 20. Thus, the change-over from the bulldozer configuration of the front end loader vehicle to the front end loader configuration can be seen to be a relatively simple procedure involving only a change in the connection between the push beam assembly 40, links 70 and either the front end loader bucket 130 or the blade mounting attachment 20 and the connection and disconnection of the hydraulic control means 120.

While the preferred embodiment of the invention has been illustrated and described, it is apparent that alterations, modifications, and changes may be made without departing from the true scope and spirit thereof as defined by the appended claims.

What I claim is:

1. An earth moving device comprising:

a powered vehicle having a pair of push beams mounted on opposite sides thereof and a pair of bucket control links mounted above and generally parallel to said push beams, said bucket control links actuated by hydraulic motor means for movement generally parallel to the axes of said push arms;

a generally "U" shaped horizontal frame member having opposite rearwardly extending legs connected by a transverse base;

a pair of rigid upright transversely spaced pivot arms fixedly mounted on said frame, one each of which being disposed adjacent the base of each of the opposite legs thereof and extending upwardly therefrom, each of said pivot arms pivotally connected at its lower end to one of said push beams and pivotally connected at a point spaced upwardly thereof to the forward end of one of said bucket control links; and a blade member pivotally connected at its backside intermediate its ends to said frame base for pivotal movement about an axis normal to said frame base at a point intermediate and forward of the junction of the base and the legs of said frame, said blade member being rotatable with said frame member about a horizontal axis when said bucket control links are actuated to rotate said frame about said horizontal axis.

2. An earth-moving device comprising:

(a) a powered vehicle having a pair of push beams mounted on opposite sides thereof;

(b) a pair of bucket control links mounted above and extending longitudinally of said push beams;

(c) hydraulic motor means carried by said vehicle and connected to said bucket control links in activating relation for controllably moving the same longitudinally of said push beams;

(d) a generally U-shaped horizontally extending frame member having opposite rearwardly extending legs connected by a transverse base;

(e) a pair of rigid upright transversely spaced pivot arms one each of which is fixedly mounted on said frame member adjacent the base of each of said opposite legs thereof, and extends upwardly therefrom;

(f) said transverse base and said pivot arms being pivotally connected to said pusher arms for movement thereof about a horizontal axis adjacent the base of each of said opposite legs;

(g) each of said pivot arms being pivotally connected to the forward end of one of said bucket control links at a point spaced upwardly of its point of pivotal connection with one of said pusher arms;

(h) a blade member having a backside pivotally connected to said frame base for pivotal movement about an axis extending normally of said frame base at a point intermediate and forward of the junction of said base and said legs of said frame member; and (i) said blade member being rotatable with said frame member about said horizontal axis of connection between said pusher arms and said frame member when said bucket control links are actuated by said hydraulic means.

3. The structure defined in claim 2 and additional hydraulic means carried by said frame member and connected to said blade member at transversely spaced points for controllably causing said blade member to pivot about said normally extending axis of of its pivotal connection with said frame member.

4. A bulldozer blade attachment for use with a front-end loader having a push-beam assembly comprising a pair of push arms connected to the frame of said front end loader and having a pair of bucket control links actuated by hydraulic motor means for movement of such links generally parallel to the axis of said push arms, said attachment comprising:

(a) a generally U-shaped horizontal frame member having opposite rearwardly extending legs immovably connected by a transverse base;

(b) a pair of rigid upright transversely spaced pivot arms immovably mounted on said frame, one each of which being disposed adjacent the base of each of said opposite legs thereof and extending upwardly therefrom;

(c) first pivot means constructed and arranged for pivotally connecting said frame member and said pivot arms to the forward end of each of such push arms for pivotal movement about a horizontal transverse axis, said first pivot means being positioned adjacent the lower end of each of said pivot arms;

(d) second pivot means carried by said pivot arms at a location spaced upwardly from said first pivot means and constructed and arranged to pivotally connect the forward end of each of such bucket control links of such a push beam assembly to a separate one of said pivot arms;

(e) a blade member having a backside pivotally connected to said frame base for pivotal movement about an axis extending normally of said frame base at a point intermediate and forward of the junction of said base and said legs of said frame member; and (f) said blade member being rotatable with said frame member about said horizontal axis of connection between said pusher arms and said frame member when such bucket control links are actuated by such hydraulic means.

* * * * *